US009683576B2

(12) United States Patent
Herran et al.

(10) Patent No.: US 9,683,576 B2
(45) Date of Patent: Jun. 20, 2017

(54) CENTRIFUGAL COMPRESSOR IMPELLER

(75) Inventors: Mathieu Herran, Pau (FR); Laurent Pierre Tarnowski, Pau (FR)

(73) Assignee: TURBOMECA, Bordes (FR)

( * ) Notice: Subject to any disclaimer, the term of this patent is extended or adjusted under 35 U.S.C. 154(b) by 634 days.

(21) Appl. No.: 14/119,454

(22) PCT Filed: May 14, 2012

(86) PCT No.: PCT/FR2012/051074
§ 371 (c)(1),
(2), (4) Date: Jan. 16, 2014

(87) PCT Pub. No.: WO2012/160290
PCT Pub. Date: Nov. 29, 2012

(65) Prior Publication Data

US 2014/0127023 A1 May 8, 2014

(30) Foreign Application Priority Data

May 23, 2011 (FR) ..... 11 54461

(51) Int. Cl.
*F04D 29/28* (2006.01)
*F04D 29/30* (2006.01)
*F04D 29/44* (2006.01)

(52) U.S. Cl.
CPC ..... *F04D 29/284* (2013.01); *F04D 29/28* (2013.01); *F04D 29/288* (2013.01); *F04D 29/30* (2013.01);
(Continued)

(58) Field of Classification Search
CPC ..... F04D 29/284; F04D 29/30; F04D 29/288; F04D 29/441; F04D 29/28; F04D 29/44; F05D 2250/52
(Continued)

(56) References Cited

U.S. PATENT DOCUMENTS 1,447,916 A 3/1923 Watkins
2,543,923 A * 3/1951 Mixsell ..... F04D 17/122 415/199.3
(Continued)

FOREIGN PATENT DOCUMENTS

DE 906 975 3/1954
EP 2 090 788 8/2009
(Continued)

OTHER PUBLICATIONS

International Search Report Issued Aug. 1, 2012 in PCT/FR12/51074 Filed May 14, 2012.
(Continued)

*Primary Examiner* — Mark A. Laurenzi, III
*Assistant Examiner* — Wesley Harris
(74) *Attorney, Agent, or Firm* — Oblon, McClelland, Maier & Neustadt, L.L.P.

(57) ABSTRACT

An impeller of a centrifugal compressor, the impeller including a web and blades secured to the web on a front face of the web. A point of intersection between a trailing edge and a blade root is at least one half-thickness of the web further forward than the blade root at an intermediate diameter of the impeller, and a point of intersection between the trailing edge and the blade tip is also further forward than the blade tip at an intermediate diameter of the impeller.

9 Claims, 2 Drawing Sheets

(52) U.S. Cl.
CPC ..... *F04D 29/44* (2013.01); *F04D 29/441* (2013.01); *F05D 2250/52* (2013.01)

(58) Field of Classification Search
USPC ..... 416/182, 185, 186 R, 188, 223 B
See application file for complete search history.

(56) References Cited

U.S. PATENT DOCUMENTS

| | | | | |
|---|---|---|---|---|
| 3,365,892 | A * | 1/1968 | Derderian ..... | F02C 3/05 415/149.4 |
| 3,904,308 | A | 9/1975 | Ribaud | |
| 5,020,971 | A * | 6/1991 | Greenspan ..... | F04D 17/162 403/356 |
| 2006/0263214 | A1 | 11/2006 | Matheny | |
| 2007/0077147 | A1 | 4/2007 | Higashimori et al. | |
| 2009/0092486 | A1 | 4/2009 | Higashimori et al. | |
| 2010/0098546 | A1 | 4/2010 | Emmerson et al. | |
| 2010/0322781 | A1 | 12/2010 | Heyes et al. | |

FOREIGN PATENT DOCUMENTS

| | | |
|---|---|---|
| GB | 553 747 | 6/1943 |
| GB | 2472621 A | 2/2011 |

OTHER PUBLICATIONS

Office Action issued Dec. 1, 2015 in Japanese Patent Application No. 2014-511930 (English translation only).

* cited by examiner

CENTRIFUGAL COMPRESSOR IMPELLER

BACKGROUND OF THE INVENTION

The present invention relates to the field of centrifugal compressors.

The invention relates more particularly to a centrifugal compressor impeller having a web and blades secured to the web on a front face of the web, each having a leading edge and a trailing edge, and the invention also relates to a centrifugal compressor including such an impeller, and to a turbine engine including such a centrifugal compressor. In this context, the term "turbine engine" designates machines such as, for example: straight-flow or bypass turbojets, turboprops, turboshaft engines, and/or turbocompressors.

In the description below, the terms "upstream" and "downstream" are defined relative to the normal flow direction of fluid through the compressor. The terms "front", "rear", "axial", and "radial" are defined relative to the axis of rotation of the impeller.

A centrifugal compressor normally has a stationary portion and a rotary portion referred to as an "impeller" and carrying the rotary blades of the compressor. In operation, the impeller typically rotates at a high speed. It is therefore subjected to centrifugal stresses.

The shape of a centrifugal compressor impeller is determined by the flow of fluid through the compressor. Typically, in such a centrifugal compressor, the fluid enters into the compressor in a direction that is substantially axial, i.e. parallel to the axis of rotation of the impeller. The flow passage and the rotary blades direct the fluid radially outwards in such a manner that the fluid leaves the impeller in a direction that is substantially orthogonal to the axis of rotation of the impeller. The blades therefore have leading edges that are substantially radial and trailing edges that are substantially axial, located further away from the axis of rotation of the impeller in the radial direction, and situated axially behind the leading edges.

The web secures the rotary blades together and secures them to the shaft of the compressor. For this purpose, each blade is secured to the web and is situated on a front face of the web. The web also serves to define the root face of the fluid flow passage through the impeller. The web is thus normally axisymmetric and curves progressively outwards in the axial direction. By virtue of the web and the blades having this shape, centrifugal acceleration generates a bending moment on the impeller tending to bend the periphery of the impeller forwards. This bending moment increases continuously going from the periphery of the impeller towards the connection between the web and the shaft of the compressor, and it makes it necessary to maintain large amounts of clearance when the compressor is operating at intermediate speeds, thereby penalizing the performance of the machine. In order to withstand this moment, proposals have typically been made to reinforce the web and the means for fastening the impeller to the rotary shaft. Nevertheless, reinforcing the rotary portions of the impeller of a compressor in this way leads to a very significant weight penalty, since weight that is added close to the air flow passage will also require an increase in the bulk of the impeller.

To overcome that drawback, U.S. Pat. No. 4,060,337 proposes eliminating a large portion of the impeller web and connecting the blades solely at the base and at the periphery. Nevertheless, that compressor suffers from a significant drop in the aerodynamic performance of the impeller as a result of flow from the pressure side to the suction side of each blade.

In British patent application GB 2 472 621 A, proposals are made to connect the impeller to the rotary shaft via two rims with an axial offset in order to restrict the presence of material on the impeller solely to its functional zones. US patent application US 2010/0098546 A1 proposes making the web of the impeller hollow in its periphery so that the peripheral weight of the impeller is limited and is positioned optimally, thereby enabling the compressor to be optimized. Nevertheless, the weight reductions that can be obtained in those two ways are penalized by the difficulty in fabricating the final single-piece part. German patent DE 906 975 proposes an impeller in which the web is further forward in the axial direction at its periphery than at an intermediate diameter of the impeller. Nevertheless, that web also requires a reinforcing disk to be fastened to the blade tips, in order to restrict deformation of the periphery of the impeller in an axial direction, which may be difficult to adapt to an existing compressor or to an aeroengine, where restricting weight is a major priority. US patent application US 2007/0077147 A1 and British patent GB 553 747 show other impellers with webs that are advanced at the periphery, but that are nevertheless not proposed for solving the problem of axial deformation of the impeller at high speeds.

OBJECT AND SUMMARY OF THE INVENTION

The present invention seeks to remedy those drawbacks. In a first aspect, a point of intersection between the trailing edge and the blade root is further forward than the blade root at an intermediate diameter of the impeller. In particular, it may be further forward by at least one half-thickness of the web. In addition, a point of intersection between the trailing edge and the blade tip is also further forward than the blade tip at an intermediate diameter of the impeller. In this way, the bending moment at the periphery of the impeller is inverted, and its maximum absolute value is made smaller, thereby limiting deformations of the impeller in the axial direction, while maintaining good aerodynamic efficiency.

In a second aspect, at the periphery of the impeller, the front face is oriented in a direction that is substantially radial. This serves to straighten out the flow of fluid at the outlet from the impeller and thus makes it possible to use a conventional radial diffuser downstream from the impeller.

In a third aspect, the impeller also includes a rim connected to a rear face of the web and suitable for being fastened to the rotary shaft. In particular, the rim may include a radial fastener disk. This makes it possible for the impeller to be fastened to the rotary shaft of the compressor in a manner that is effective and comparatively light in weight.

In a fourth aspect, the centrifugal compressor also has a cover covering the blades so as to co-operate with the web to define a fluid flow passage between the leading edges and the trailing edges of the blades. The aerodynamic losses of the centrifugal compressor can thus be reduced significantly in this way by limiting fluid overflowing from the pressure side to the suction side of each blade. In particular, the cover may then include at least one fastener point closer to the trailing edges of the blades of the impeller than to the leading edges of the blades of the impeller. Since the axial movement of the radial periphery of the impeller at high speed can be limited by the non-bijection in the axial direction of the curve formed by the front face of the web, the axial fastening of the cover may be located closer to the periphery of the impeller, thus making it possible to limit clearance between the cover and the blades of the impeller at the periphery of the impeller at intermediate speeds, thereby increasing aerodynamic efficiency. Alternatively, the cover may be secured to the blades, so as to form a closed impeller.

BRIEF DESCRIPTION OF THE DRAWINGS

The invention can be well understood and its advantages appear better on reading the following detailed description of embodiments given as non-limiting examples. The description refers to the accompanying drawings, in which.

DETAILED DESCRIPTION OF THE INVENTION

Figure 1:
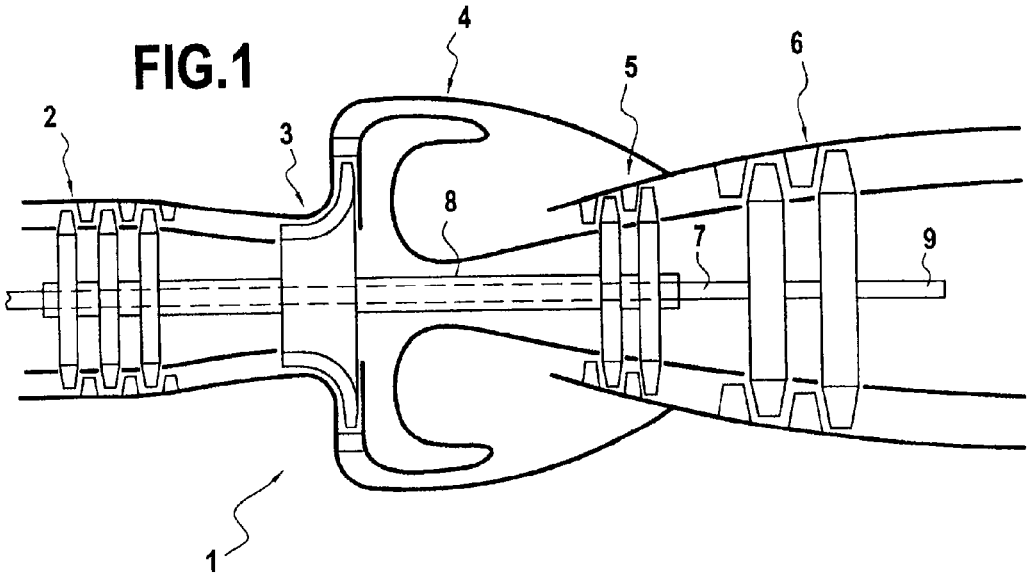
FIG. 1 is a diagrammatic longitudinal section view of a turbine engine including a centrifugal compressor.

A turbine engine, and more specifically a turboshaft engine 1 is shown diagrammatically by way of explanation in FIG. 1. In the flow direction of a working fluid, the turboshaft engine 1 comprises: an axial compressor 2; a centrifugal compressor 3; a combustion chamber 4; a first axial turbine 5; and a second axial turbine 6. In addition, the turboshaft engine 1 has a first rotary shaft 7 and a second rotary shaft 8 coaxial with the first rotary shaft 7.

The second rotary shaft 8 connects the axial compressor 2 and the centrifugal compressor 3 to the first axial turbine 5 so that the expansion of the working fluid through the first axial turbine 5 downstream from the combustion chamber 4 serves to drive the compressors 2 and 3 upstream from the combustion chamber 4. The first rotary shaft 7 connects the second axial turbine 6 to a power outlet 9 positioned downstream and/or upstream of the engine, in such a manner that the subsequent expansion of the working fluid in the second axial turbine 6 that is downstream from the first axial turbine 5 serves to drive the power outlet 9.

Figure 2:
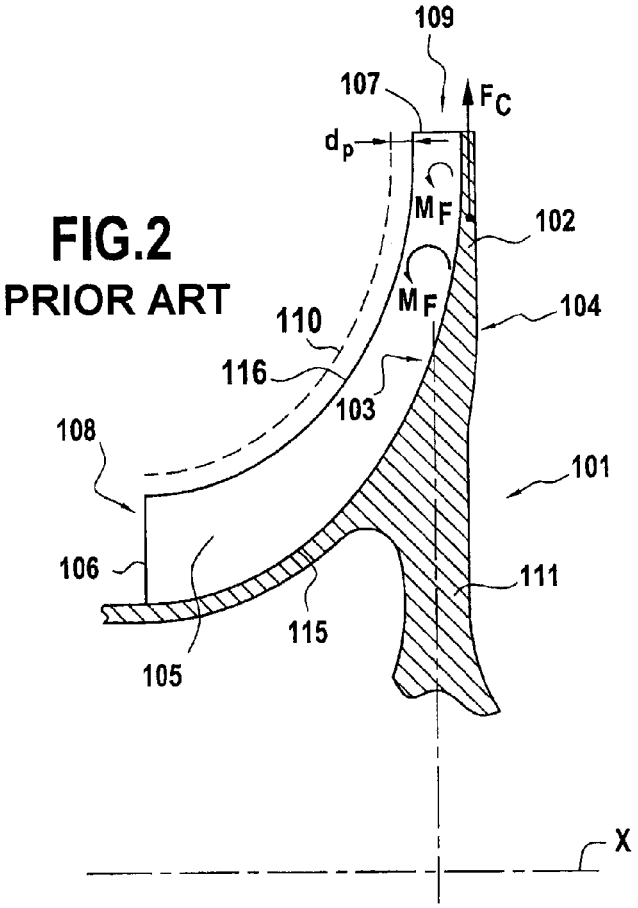
FIG.2 PRIOR ART
FIG. 2 is a longitudinal section view of an impeller for a prior art centrifugal compressor.

Thus, the consecutive compressions of the working fluid in the axial and centrifugal compressors 2 and 3, followed by heating of the working fluid in the combustion chamber 4, and by its expansion in the second axial turbine 6 serves to convert a fraction of the thermal energy obtained by combustion in the combustion chamber 4 into mechanical work that is extracted via the power outlet 9. In the turbine engine shown, the driving fluid is air, with fuel being added thereto and burnt in the combustion chamber 4, which fuel may be a hydrocarbon, for example. In operation, the rotary shafts 7 and 8 rotate at speeds of about 5000 revolution per minute (rpm) to 60,000 rpm. The rotary portions of the compressors 2 and 3 and of the turbines 5 and 6 are therefore subjected to high levels of centrifugal forces. With reference to FIG. 2, it can be seen how these centrifugal forces act on the impeller 101 of a conventional centrifugal compressor that is known to the person skilled in the art. The impeller 101 has a substantially axisymmetric web 102 presenting a front face 103 and a rear face 104. Blades 105 are fastened via blade roots 115 on the front face 103 of the web 102. Each blade 105 also presents a blade tip 116 remote from the blade root 115, a leading edge 106 that is oriented substantially radially, and a trailing edge 107 that is oriented substantially axially, and that is situated radially outside and axially behind the leading edge 106. In operation, the working fluid is thus sucked into the front 108 of the impeller 101 and is directed by the blades 105 towards the periphery 109 of the impeller 101 following a fluid flow passage defined on the inside by the web 102 and on the outside by a non-rotary cover 110 of the centrifugal compressor that is located close to the blade tip 116.

On its rear face, the web 102 is secured to a rim 111 having a disk for fastening to the rotary shaft. The rim 111 and the disk thus define a plane A for transmitting radial forces from the impeller 101 to the rotary shaft. Because of the high speeds of rotation of the impeller 101, the centrifugal forces exerted on the impeller 101 represent a major portion of these radial forces. Nevertheless, since centrifugal force $F_c$ is proportional to the square of the angular speed of rotation ω multiplied by the distance from the axis of rotation X of the impeller 101, in application of the formula $\omega^2 r$, the centrifugal forces exerted at the periphery 109 of the impeller 101 are preponderant. Thus, in the conventional impeller 101 as shown, the centrifugal forces $F_c$ acting on the periphery 109 of the impeller 101 create a bending moment $M_F$ in the impeller 101 tending to cause the periphery 109 of the impeller 101 to tilt forwards. This bending moment $M_F$ increases continuously from the periphery 109 of the impeller 101 to the junction between the web 102 and the rim 111. In order to limit bending of the impeller 101, the web 102, the rim 111, and the disk need to be reinforced, thereby leading to a considerable increase in the total weight of the impeller 101. In addition, in order to accommodate the forward movement at the periphery 109 of the impeller 101, it is normally necessary to arrange for a large amount of clearance $d_p$ at the periphery of the impeller 101 between the blade tips 105*b* and the cover 110 while operating at less than full speed, and this leads to high levels of aerodynamic losses, or it may even be necessary to arrange rather complex fastener structures for the cover 110 for the purpose of causing the cover 110 to move forwards with an increase in the speed of the compressor.

Figure 3:
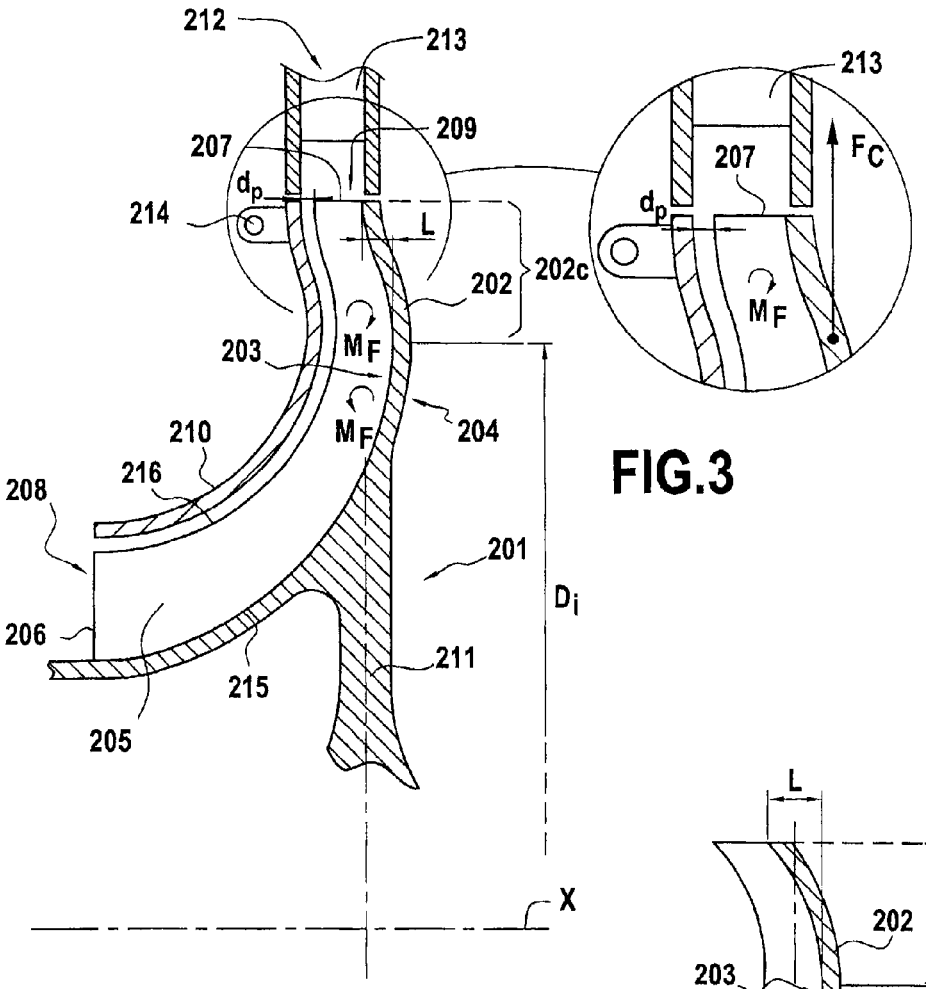
FIG. 3 is a longitudinal section view of a centrifugal compressor in a first embodiment of the invention.

FIG. 3 shows the centrifugal compressor 3 with an impeller 201 in a first embodiment of the invention. This impeller 201 likewise has a substantially axisymmetric web 202 with a front face 203 and a rear face 204. As in the impeller shown in FIG. 2, the blades 205 are fastened via blade roots 215 on the front face 203 of the web 202, with each blade also presenting a blade tip 216 remote from the blade root 215, a leading edge 206 of substantially radial orientation, and a trailing edge 207 of substantially axial orientation, situated radially outside and axially behind the leading edge 206. Around the periphery of the impeller 201, the compressor 3 has a conventional radial diffuser 212 with guide vanes 213. In operation, the working fluid is thus sucked in through the front 208 of the impeller 201 and directed by the blades 205 towards the periphery 209 of the impeller 201 following a fluid flow passage defined on the inside by the web 202 and on the outside by the non-rotary cover 210, in order to each the radial diffuser 212.

On its rear face, the web 202 is also secured to a rim 211 having a disk for fastening to the rotary shaft. Nevertheless, in this impeller 201, the web 202 is curved so that a peripheral segment of the web 202 slopes forwards from an intermediate diameter $D_i$, thereby presenting a front face 203 that is concave. As a result, at the periphery 209 of the impeller 201, this front face 203 is moved forwards through a distance L relative to the intermediate diameter $D_i$. This distance L is substantial, and in particular it is greater than half the thickness d of the web 202 at the periphery 209 of the impeller 201. Consequently, on a forwardly-facing peripheral segment 202*c* the centrifugal forces $F_c$ generate a bending moment $M_F$ that tends to cause the peripheral segment 202*c* to bend not forwards, but in the opposite direction, i.e. rearwards. The magnitude of this bending moment $M_F$ increases going from the periphery 209 to the intermediate diameter $D_i$, where it reaches a local maximum. Thereafter, it decreases, possibly to such an extent as to reverse the direction of the bending moment $M_F$. Thus, since the bending moment $M_F$ does not increase continuously from the periphery 209 to the junction of the web 202 with the rim 211, it reaches levels that are significantly smaller than in the prior art impeller 101, thereby enabling a rim 211 and a fastener disk to be used that are lighter in weight. In addition, since the axial movements of the periphery 209 of the impeller 201 is made smaller, the clearance $d_p$ between the tips of the blades 205 at the periphery of the impeller 201 and the cover 210 may also be made smaller, and the cover 210 may be fastened in comparatively rigid manner on a fastener point 214 closer to the rear of the cover 210 and thus to the trailing edges 207 than to the front of the cover 210 and the leading edges 206.

An additional advantage lies in the smaller axial size of the impeller 201, in particular in the smaller axial distance between the inlet for the working fluid at the front of the impeller 201 and its outlet at the periphery 209 of the impeller 201. In particular, in a turbine engine such as the turboshaft engine 1 shown in FIG. 1, this makes it possible to move the downstream elements of the compressor forwards to a significant extent, i.e. in the embodiment shown, the hot portions such as the combustion chamber 4 and the first and second axial turbines 5 and 6 can be moved forwards, thereby reducing the overall axial size of the turbine engine.

In the embodiment shown in FIG. 3, the outer edge of the peripheral segment 202*c* of the web 202 is curved so as to redirect the front face 203 of the web 202 in a radial direction, thereby ensuring that the fluid flow passage returns to a radial direction so as to make it possible to use the conventional radial diffuser 212 as shown. Nevertheless, in an alternative embodiment as shown in FIG. 4, in which each equivalent element is given the same reference number as in FIG. 3, the fluid flow passage is not brought back to the radial direction, thereby making it easier to produce the impeller, even though the diffuser downstream from the impeller needs to be modified to match.

Figure 4:
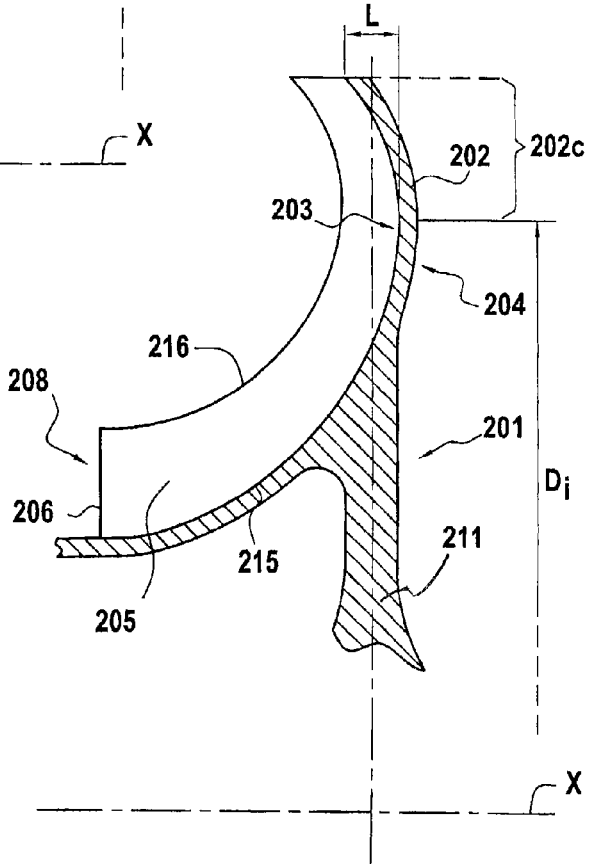
FIG. 4 is a longitudinal section view of an impeller for a centrifugal compressor in a second embodiment of the invention.

A centrifugal compressor with an impeller 201 of the kind shown in FIGS. 3 and 4 may be used, among other uses, in turbine engines such as the turboshaft engine 1 shown in FIG. 1, however it can also be used in straight-flow or bypass turbojets, in turboprops, in turboshaft engines, and/or in turbocompressors. Because of its smaller weight, it is particularly advantageous in an aviation application, such as for example propelling fixed wing and/or rotary shaft aircraft, with or without a pilot, whether they be lighter than air or heavier than air. Nevertheless, other non-aviation applications known to the person skilled in the art may also be envisaged, such as for example propelling terrestrial and/or waterbourne vessels, including air cushion vehicles, generating electricity, pumping stations, and/or other industrial applications. Such a centrifugal compressor may constitute the only stage of a compression system or one or more stages of a multi-stage compression system involving stages that may be axial, centrifugal, or mixed axial and centrifugal, i.e. having at least one centrifugal stage and a stage that is axial or mixed.

Although the present invention is described with reference to specific embodiments, it is clear that various modifications and changes may be performed on those embodiments without going beyond the general ambit of the invention as defined by the claims. In particular, individual characteristics of the various embodiments shown may be combined in additional embodiments. Consequently, the description and the drawings should be considered in an illustrative rather than a restrictive sense.

The invention claimed is:

1. An impeller for a centrifugal compressor, the impeller comprising:

a web and blades secured to the web on a front face of the web, each blade including a blade root, a blade tip, a leading edge, and a trailing edge, wherein a point of intersection between the trailing edge and the blade root is further forward, by at least one half-thickness of the web, relative to the blade root at an intermediate diameter of the impeller, wherein a point of intersection between the trailing edge and the blade tip is also further forward relative to the blade tip at the intermediate diameter of the impeller, wherein the blade root at a periphery of the impeller is radially oriented, and wherein said web comprises a first curved peripheral segment with a concave front face segment, said first curved peripheral segment extending toward a periphery of said impeller from said intermediate diameter, and a second curved peripheral segment with a convex front face segment, said second curved peripheral segment extending toward said periphery of said impeller from said first curved peripheral segment.

2. An impeller for a centrifugal compressor according to claim 1, further comprising a rim connected to a rear face of the web and configured to be fastened to a rotary shaft.

3. A centrifugal compressor comprising:

an impeller including:

a web and blades secured to the web on a front face of the web, each blade including a blade root, a blade tip, a leading edge, and a trailing edge, wherein a point of intersection between the trailing edge and the blade root is further forward, by at least one half-thickness of the web, relative to the blade root at an intermediate diameter of the impeller, wherein a point of intersection between the trailing edge and the blade tip is also further forward relative to the blade tip at the intermediate diameter of the impeller, wherein the blade root at a periphery of the impeller is radially oriented, and wherein said web comprises a first curved peripheral segment with a concave front face segment, said first curved peripheral segment extending toward a periphery of said impeller from said intermediate diameter, and a second curved peripheral segment with a convex front face segment, said second curved peripheral segment extending toward said periphery of said impeller from said first curved peripheral segment.

4. A centrifugal compressor according to claim 3, further comprising a cover covering the blades to co-operate with the web to define a fluid flow passage between the leading edges and the trailing edges of the blades.

5. A centrifugal compressor according to claim 4, wherein the cover includes at least one fastener point closer to the trailing edges of the blades of the impeller than to the leading edges of the blades of the impeller.

6. A centrifugal compressor according to claim 3, wherein said web is configured such that, when centrifugal forces are applied to the first and second curved peripheral segments of said web, said centrifugal forces generate a bending moment that causes the first and second peripheral segments to bend rearwards.

7. A centrifugal compressor according to claim 6, wherein said bending moment increases from the periphery of said impeller to said intermediate diameter.

8. A centrifugal compressor according to claim 7, wherein said bending moment reaches a local maximum at said intermediate diameter.

9. A turbine engine comprising:

an axial compressor;

a centrifugal compressor;

a combustion chamber; and at least one axial turbine;

wherein the centrifugal compressor including an impeller including a web and blades secured to the web on a front face of the web, each blade including a blade root, a blade tip, a leading edge, and a trailing edge, wherein a point of intersection between the trailing edge and the blade root is further forward, by at least one half-thickness of the web, relative to the blade root at an intermediate diameter of the impeller, wherein a point of intersection between the trailing edge and the blade tip is also further forward relative to the blade tip at the intermediate diameter of the impeller, wherein the blade root at a periphery of the impeller is radially oriented, and wherein said web comprises a first curved peripheral segment with a concave front face segment, said first curved peripheral segment extending toward a periphery of said impeller from said intermediate diameter, and a second curved peripheral segment with a convex front face segment, said second curved peripheral segment extending toward said periphery of said impeller from said first curved peripheral segment.

* * * * *